US006499801B1

(12) United States Patent
Peterson et al.

(10) Patent No.: US 6,499,801 B1
(45) Date of Patent: Dec. 31, 2002

(54) CHAIR HAVING REMOVABLE COVER AND CUSHION

(75) Inventors: Gordon J. Peterson, Rockford; George J. Simons, Jr., Grand Rapids, both of MI (US); Thomas Overthun, San Francisco, CA (US); Ronda Simons, Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/518,276

(22) Filed: Mar. 3, 2000

(51) Int. Cl.[7] ..... A47C 31/00

(52) U.S. Cl. ..... 297/228.13; 297/219.1; 297/440.22

(58) Field of Search ..... 297/228.13, 440.22, 297/219.1

(56) References Cited

U.S. PATENT DOCUMENTS

| | | | |
|---|---|---|---|
| D29,038 | S | 7/1898 | Heaton |
| 625,137 | A | 5/1899 | Bowman |
| 766,250 | A | 8/1904 | Hermann |
| 770,973 | A | 9/1904 | Lippert |
| 773,583 | A | 11/1904 | Nagely |
| 1,005,330 | A | 10/1911 | Schmits et al. |
| 2,170,224 | A | 8/1939 | Tarr |
| 2,239,457 | A | 4/1941 | Gibbons |
| 2,354,436 | A | 7/1944 | Stedman |
| 2,771,939 | A | 11/1956 | Trubitt |
| 3,223,450 | A | 12/1965 | Pollock |
| D205,112 | S | 6/1966 | Arnold |
| 3,669,499 | A | 6/1972 | Semplonius et al. |
| 4,504,991 | A | 3/1985 | Klancnik |
| 4,624,396 | A | 11/1986 | Universe |
| 4,798,416 | A | 1/1989 | Faust et al. |
| 4,892,769 | A | 1/1990 | Perdelwitz, Jr. et al. |
| 5,064,247 | A | 11/1991 | Clark et al. |
| D323,072 | S | 1/1992 | Anderson et al. |
| 5,110,186 | A | 5/1992 | Clark et al. |
| 5,297,851 | A | 3/1994 | Van Hekken |
| 5,302,001 | A | 4/1994 | Van Dis |
| 5,318,346 | A | 6/1994 | Roossien et al. |
| D353,944 | S | 1/1995 | Goodman et al. |
| 5,433,505 | A | 7/1995 | Coyne et al. |
| 5,533,787 | A | 7/1996 | Xiang |
| 5,630,643 | A | 5/1997 | Scholten et al. |
| D389,325 | S | 1/1998 | Kedzior |
| 5,758,806 | A | 6/1998 | Anderson |
| 5,758,924 | A | 6/1998 | Vishey |
| 5,816,654 | A | 10/1998 | Ellis |
| 5,820,214 | A | 10/1998 | Bessette et al. |
| 5,824,264 | A | 10/1998 | Uno et al. |
| 6,014,783 | A | 1/2000 | Collier et al. |

FOREIGN PATENT DOCUMENTS

| | | |
|---|---|---|
| GB | 785213 | 10/1957 |

*Primary Examiner*—Peter M. Cuomo
*Assistant Examiner*—Joseph Edell
(74) *Attorney, Agent, or Firm*—Price Heneveld Cooper Dewitt & Litton

(57) ABSTRACT

A chair includes a seat with male snap connectors thereon and a back. A cushion assembly has female snap connectors shaped to engage the male snap connectors for securement. The cushion assembly includes a dimensionally-stable fabric that holds the snap connectors in a stable pattern, and the male and female snap connectors engage in a manner that locates and secures the cushion assembly on the seat. The cushion assembly is easily and quickly removed from the seating unit, and can be quickly dry-cleaned, washed, or repaired, and reattached to the chair. A back cushion assembly is provided that can be pulled downwardly onto the back, and stretch-attached along its bottom edge. A removable seet through fabric vest can also be pulled downwardly over the back and releasably attach to a bottom edge of the back. A hanger is provided for supporting extra vests, back cushion assemblies and seat cushion assemblies.

30 Claims, 9 Drawing Sheets

CHAIR HAVING REMOVABLE COVER AND CUSHION

BACKGROUND OF INVENTION

The present invention relates to chairs having cushion assemblies and covers, and more particularly relates to chairs having cushion assemblies and covers that can be removed for cleaning, repair, and maintenance.

Modern chairs often include fabric-covered cushions to improve comfort. A problem is that fabric-covered cushions get dirty, worn, and damaged, such that they need cleaning and maintenance. However, they are typically permanently attached to the chairs, and are not easily removed or repaired. In schools, medical facilities, and high-use areas such as airports, it is often desirable to sanitize the chairs, but cushioned chairs with fabric are porous and not easily sanitized. Certainly, wiping them is not sufficient. Even beyond these problems, customers often want to upgrade or change the color schemes and designs of their offices. However, it is costly to recover chairs. Also, there are problems with using customer's own fabrics. Customer's own fabrics are specific fabrics picked out by a customer. A problem with using them is that they often have unusual or specialized color schemes or other special characteristics. A problem with these customer's own fabrics is that they may not have the properties desired by the chair manufacturers. For example, fabrics vary widely in their physical properties, such as their stretchability, strength, colorfastness, and the like. For all of these reasons, it is desirable to have cushion assemblies that are able to incorporate customer's own fabrics in a manner that allows cushions to be structurally "semi-independent" of the seat and back support structures of a chair, so that they can be removed for cleaning or replacement, and so that the chair design does not require certain properties in the fabric for the fabric to look acceptable and wear acceptably on the chair. Still further, attachment and covering schemes are desired that provide a modernistic appearance, yet that facilitate assembly and repair. Also, accessories are desired to help store extra cushion and covering assemblies that may be used.

Accordingly, chair constructions are desired that solve the aforementioned problems and that have the aforementioned advantages.

SUMMARY OF THE INVENTION

In one aspect of the present invention, a chair includes a seating unit including a seat structure and a back structure where at least one of the structures includes a face adapted to support a person seated thereagainst, with the face having an arrangement of first connectors thereon. A removable cushion assembly includes a cushion, a top covering, and a stabilizing bottom covering that has less than a 5% elongation when stretched and that is sewn to the top covering around the cushion. The removable cushion assembly also has an arrangement of second connectors attached to the bottom covering proximate corners of the cushion and that are releasably attached to the first mechanical connectors for securing the cushion assembly to the one structure. The first and second connectors are configured to release and disengage when the removable cushion assembly is pulled from the one structure.

In another aspect of the present invention, a cushion assembly includes a cushion, a covering on the cushion, and a sheet under the cushion. The sheet is attached along edges to the covering to encapsulate the cushion. The sheet is chosen for its dimensional stability and has an elongation when stretched of less than about 5%. A plurality of mechanical connectors are attached to the sheet and arranged in a predetermined pattern on the sheet so that the mechanical connectors can be accurately attached to a seating component.

In another aspect of the present invention, a method includes steps of providing a seating unit and a cushion assembly attached in at least four corner locations to the seating unit with releasable connectors. The method further includes steps of removing the cushion assembly from the seating unit by disengaging the connectors. The method also includes performing maintenance on the cushion assembly including one of cleaning and refurbishing a component of the cushion assembly and reattaching the cushion assembly to the seating unit by re-engaging the connectors.

In another aspect of the present invention, a seating unit includes a back with a front face, an upper edge, and a lower edge. A removable fabric vest covers a majority of the front face of the back and includes an upper portion releasably attached to the upper edge and a lower portion releasably attached to the lower edge.

In yet another aspect of the present invention, a seating unit includes a back, and a covering attached to the back including a top connector and a bottom connector. The bottom connector includes a stretchable material. A fire-resistant covering is provided that covers the stretchable material to provide improved resistance to fire damage.

Another aspect of the present invention includes a chair comprising a seating unit which includes a seat structure and a back structure, both of which are supported for synchronous movement upon recline. At least one of the structures includes a face adapted to support a person seated thereagainst. The face has an arrangement of first mechanical connectors thereon. The chair also includes a removable cushion assembly with an arrangement of second mechanical connectors that releasably snap-attach to the first mechanical connectors and also secure the cushion assembly to the one structure.

In another aspect of the present invention, a chair comprising a seating unit includes a seat structure having an arrangement of six fixed snap-attach connectors thereon. A removable cushion assembly with an arrangement of six mating snap-attach connectors are releasably attached to the fixed snap-attach connectors and secure the cushion assembly to the one structure.

In another aspect of the present invention, a hanger is provided that is adapted to support a back covering for a chair, where the back covering includes a front panel shaped to cover a front surface of the chair back and where the back covering also includes a rear panel sewn to the front panel along a top edge of the rear panel to define a pocket for engaging and hanging on a top edge of the chair back. The hanger includes a center section having a hook adapted to hang on a bar and has an elongated stem. Opposing wing sections attach only to a bottom of the elongated stem. The opposing wing sections have an upper edge shaped to replicate the top edge of the chair back so that the vest will hang on the hanger when the wing sections are extended into the pocket. In a narrower aspect, a cushion assembly and a vest are hung as a set on the hanger.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
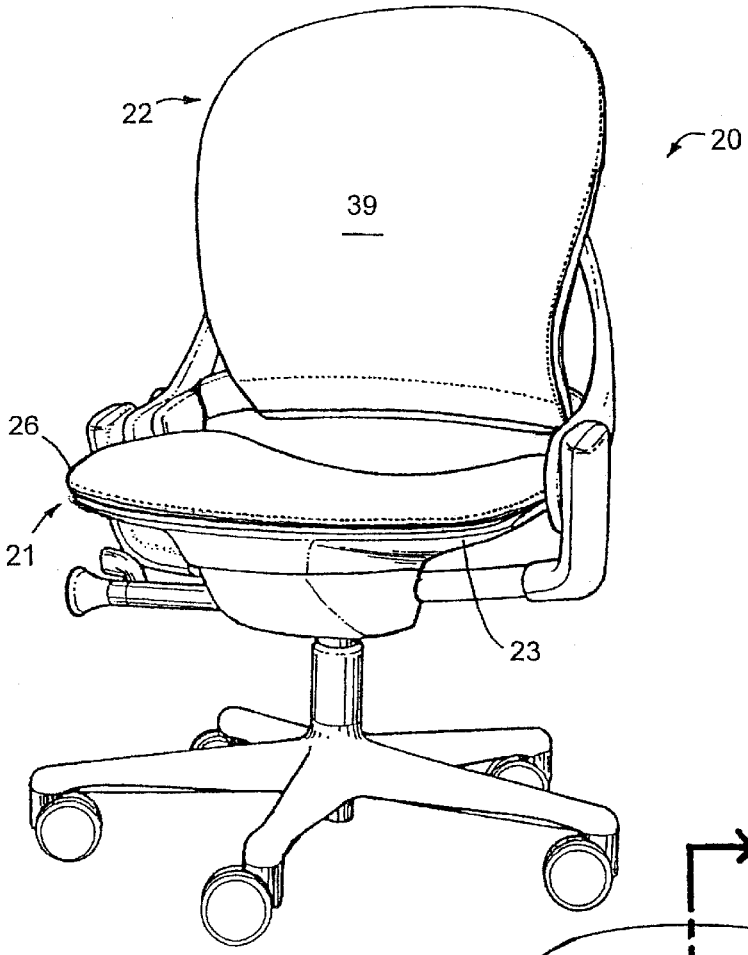
FIG. 1 is a front perspective view of a chair embodying the present invention.
Figure 2:
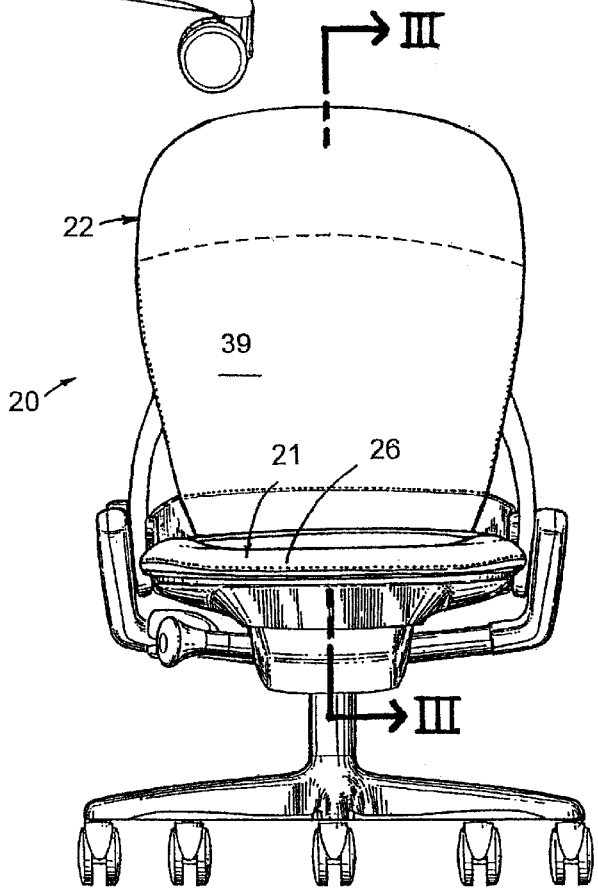
FIG. 2 is a front view of the chair in FIG. 1.
Figure 3:
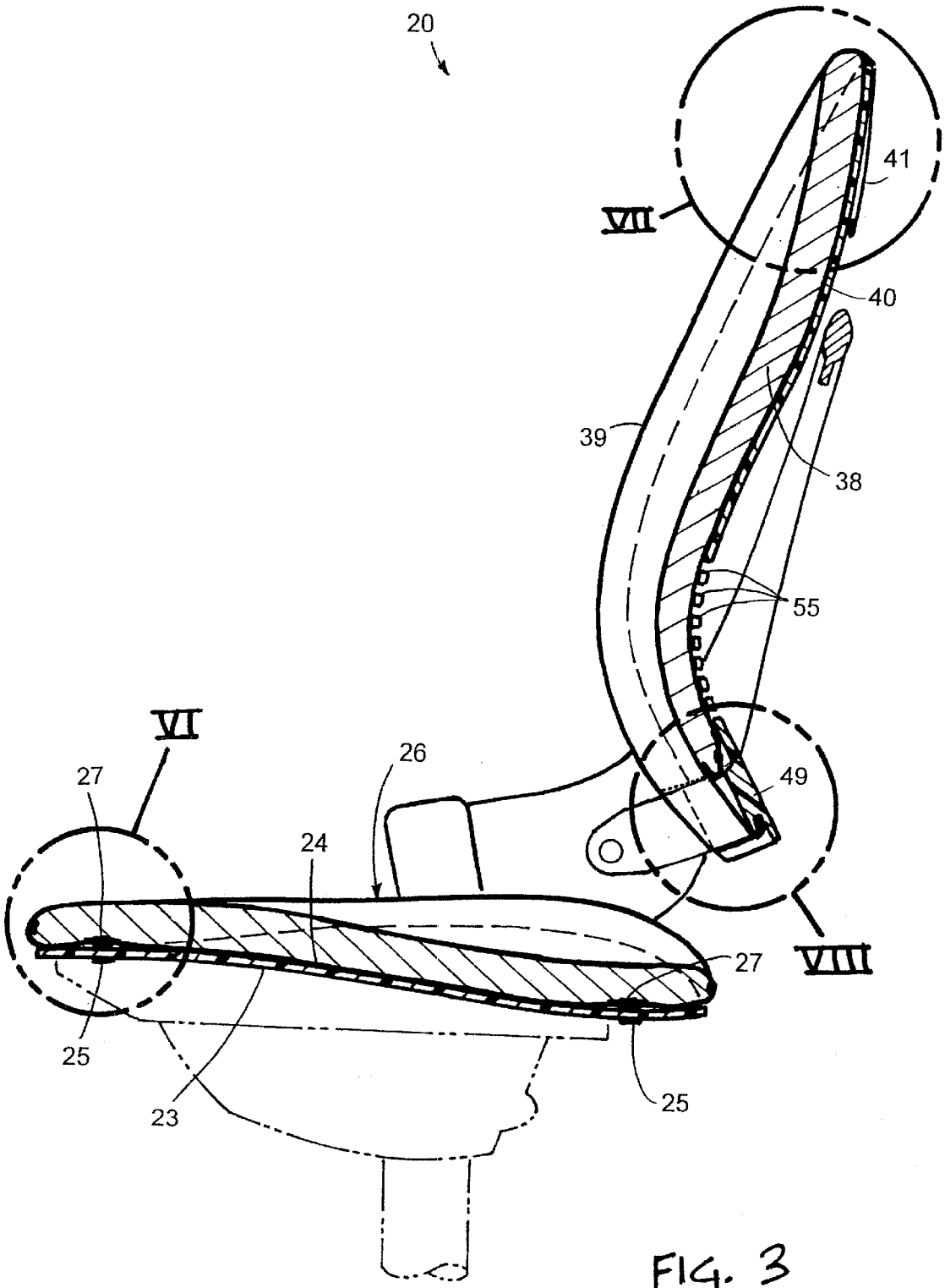
FIG. 3 is a side cross sectional view taken along line III—III of the chair shown in FIG.
Figure 3A:
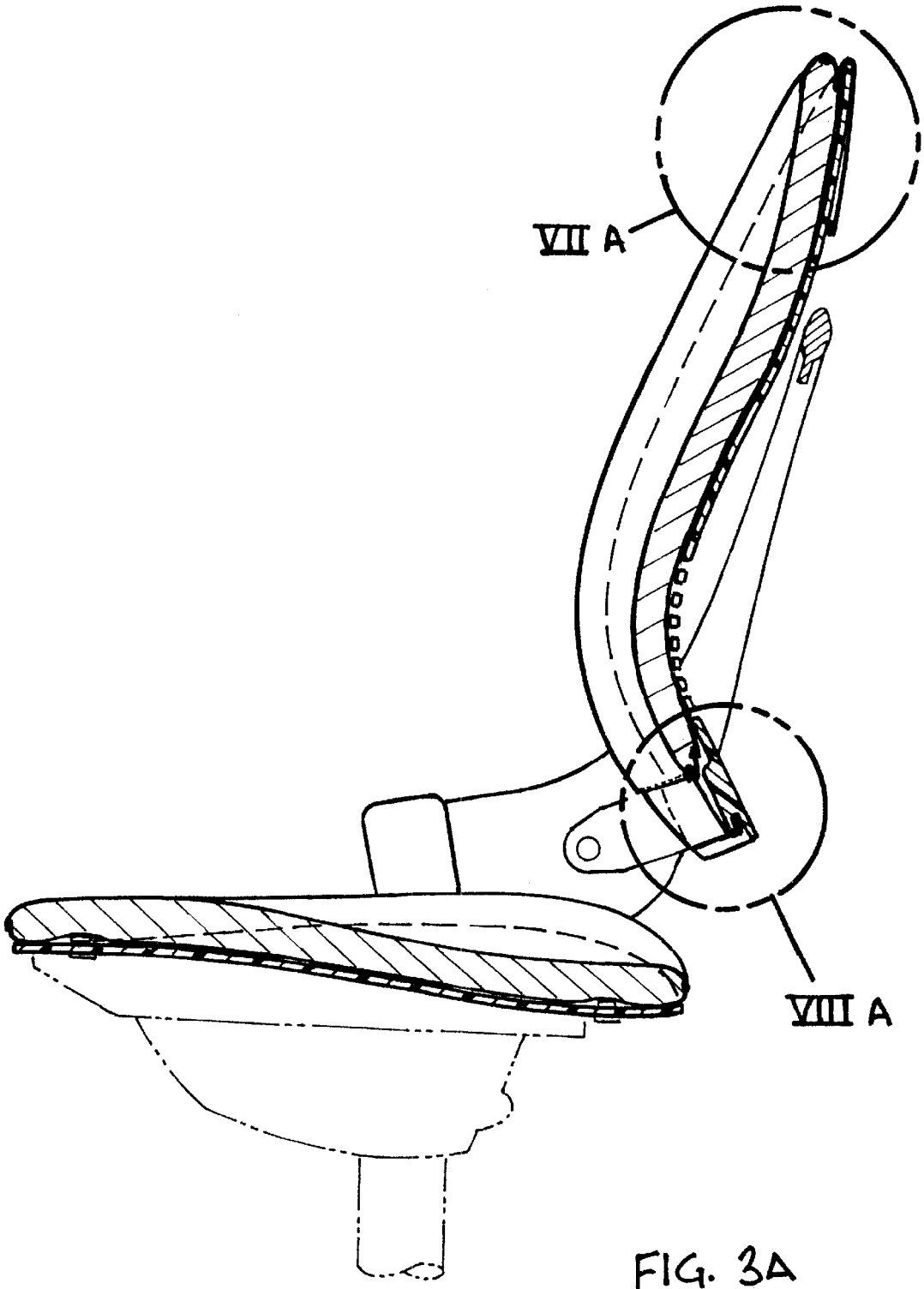

A chair 20 (FIG. 1) embodying the present invention includes a cushioned seat 21 and a cushioned back 22. The details of the support structure forming the present seat and back are disclosed in U.S. Pat. No. 5,871,258, issued Feb. 16, 1999, entitled CHAIR WITH NOVEL SEAT CONSTRUCTION, and the entire contents of the '258 patent are incorporated herein for the purpose of providing a complete disclosure of the same. In the present invention, the seat 21 (FIG. 3) has a seat support structure 23 with an upwardly oriented face covered by a fabric covering 24 for aesthetics. An arrangement of several male snap connectors 25 are secured in recesses 25' to the seat support structure 23, such as by attaching the snap connectors 25 to a resilient polymeric seat shell of the support structure 23. A seat cushion assembly 26 includes a mating pattern of mating female snap connectors 27 that are configured and arranged to snappingly engage the male snap connectors 25. By this arrangement, the seat cushion assembly 26 can be snap-attached to the seat support structure 23 for quick removal, such as for washing, dry-cleaning, repair, or maintenance.

Figure 4:
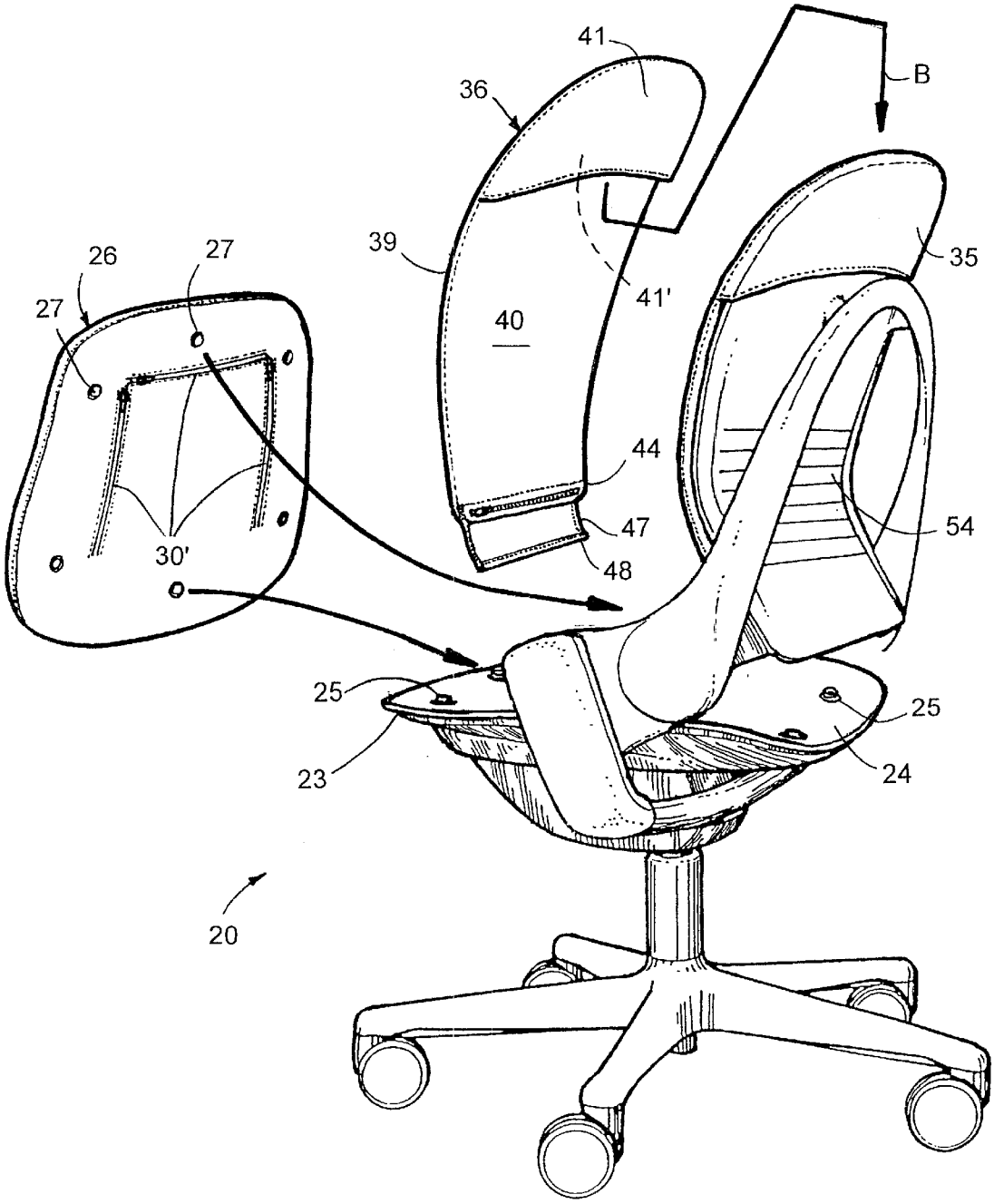
FIG. 4 is an exploded side perspective view of FIG. 1.
Figure 5A:
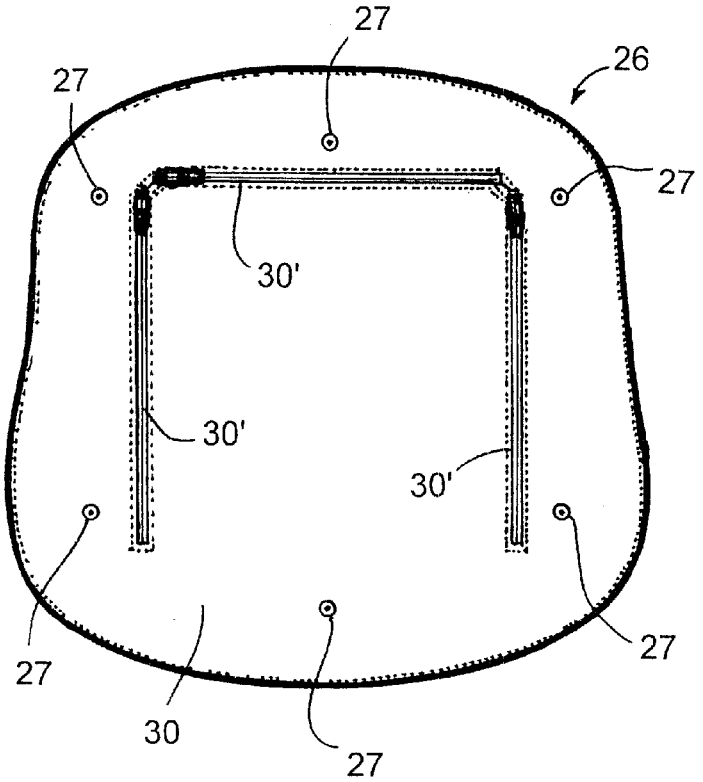
FIGS. 5 and 5A are mating faces of the seat cushion assembly and the seat, respectively, each having a pattern of mating snap-attach connectors thereon.
Figure 5B:
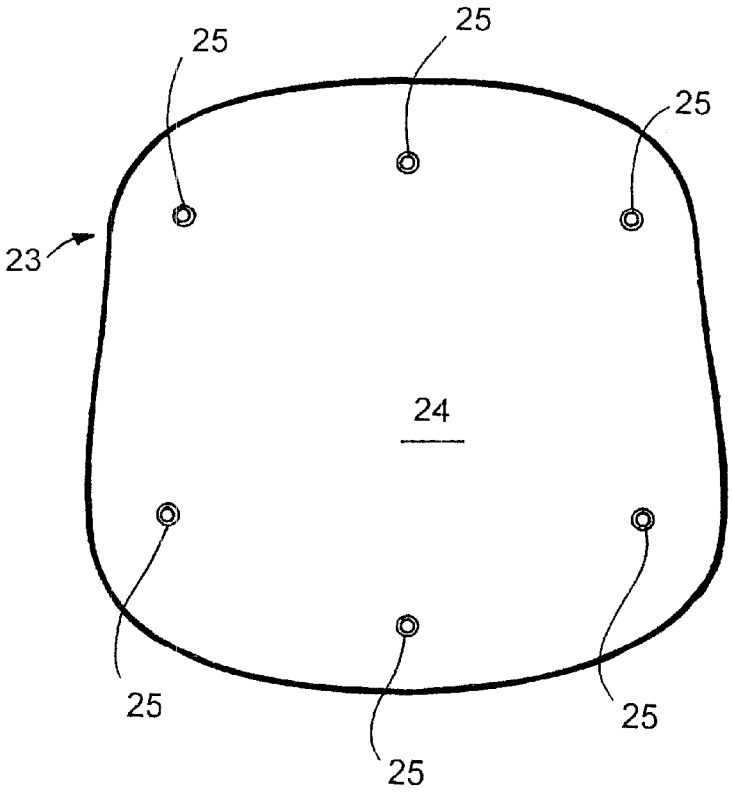

The fabric covering 24 covers the seat support structure 23 (FIG. 4) for aesthetic reasons when the seat cushion assembly 26 is removed, and also covers the seat support structure 23 for functional reasons, such as to prevent articles from falling into the mechanisms within the seat support structure 23. Preferably, the covering 24 is a durable material that will not easily rip or wear. Where the fabric covering 24 is sufficiently strong, the snap connectors 25 can be attached only to the covering 24, and edges of the covering 24 are adhered or otherwise secured to the seat support structure 23. However, in a preferred form, the snap connectors 25 extend through and are secured in recesses 25' to a flexible plastic shell that forms part of the seat support structure 23.

Figure 6:
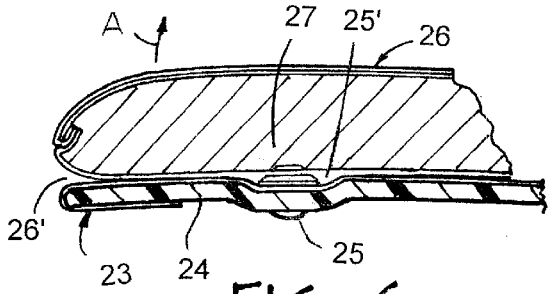
FIGS. 6 and 6A are side cross sectional views of one of the snap-attach connectors, FIG. 6 showing the connectors engaged and being enlarged from the circled area VI in FIG. 3, FIG. 6A showing the connectors disengaged.
Figure 6A:
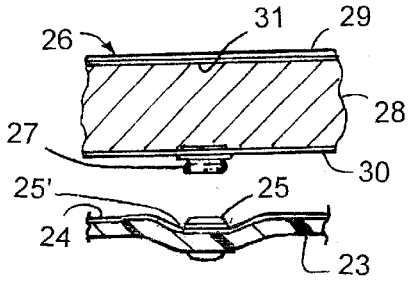

The seat cushion assembly 26 (FIG. 6A) includes a cushion 28, a top covering 29, and a bottom covering 30. The cushion 28 can be a conventional polyurethane resilient foam, or can be a non-woven resilient fibrous material, or can be any reasonable material capable of providing resilient comfortable support to a seated user. The top covering 29 can be a manufacturer-chosen covering material or a customer's own material. Where a customer's own material is used, a secondary stabilizing covering sheet 31 is used to provide integrity to the assembly. The bottom covering 30 must provide stable support for the snap connectors 27, both so that the snap connectors 27 do not rip out of the covering 29 during pull-off of the seat cushion assembly 26, and also so that the arrangement of snap connectors 27 stay in a dimensionally accurate position so that they can be easily re-attached to the other connectors 25, even though it is a "blind" process. Preferably the bottom covering 30 is a sheet of nonwoven fabric having a stretch of less than 5%. For example, a 10–15 ounce non-woven sheet of polyester cloth can be used for this purpose. Notably, the combination of the seat cushion assembly 26 snap-attached to the seat support structure 23 provides a novel, crevice-shaped appearance at a location 26' (FIG. 6) sometimes referred to as a "throw-rug" type look. This "look" provides a novel "relaxed" appearance that is well-liked by computer operators and "high-tech" consumers.

The seat cushion assembly 26 is a separate unit that is easily removed by pulling on the assembly 26 in direction "A" (FIG. 6) and can be easily re-attached by pressing through the cushion 28 against the snap connectors 27. This arrangement greatly improves the ability of a chair manufacturer to competitively make chairs that incorporate customer's own materials, because the cushion assembly 26 is stable and thus does not depend on the customer's own material for strength or integrity. Further, the customer's own materials can be used without major logistic problems, since the cushions are separable and can be shipped from separate locations. For example, the cushions can be prepared at a local manufacturing site separate from the chair manufacturing plant. The present arrangement is considered to have surprising and unexpected qualities of dependability and reliability, even where customer's own materials are used that do not have the requisite strength and other properties normally required by customers and chair manufacturers. Alternatively, it is noted that the snap connectors 27 can extend through the cushion 28 and be located in depressions in the fabric 29. Three zippers 30' (FIG. 4) are provided in the bottom covering 30 so that the cushion 28 can be stuffed into the seat cushion assembly. Notably, one or more of the zippers 30' can be replaced by hook-and-loop material, snaps, or other attachment means to reduce cost and facilitate assembly.

Figure 7:
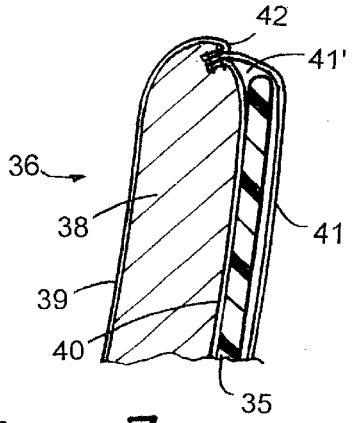
FIGS. 7, 7A and 7B are side cross sectional views of three different top hem arrangements on the back cushion assembly, FIG. 7 being enlarged from the circled area VII in FIG. 3.
Figure 7A:
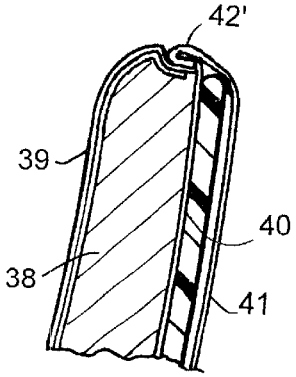
Figure 7B:
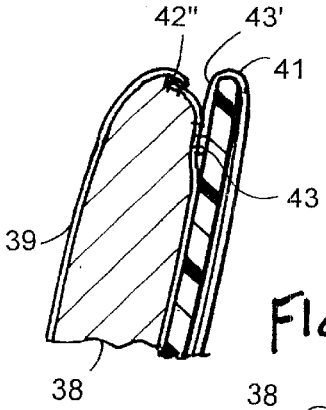

The back 22 (FIG. 4) includes a back support structure or shell 35 and a back cushion assembly 36. The back cushion assembly 36 includes a cushion 38, a front covering 39, and a back covering 40. A crescent-shaped section of material 41 is sewn along a top edge of the coverings 39 and 40 to form a top seam 42 and a downwardly facing pocket or sock-like cavity 41'. The seam 42 can be created in numerous ways, three of which are illustrated. In FIG. 7, the seam 42 is created by sewing edges of the three materials 39, 40, and 41 together, with all edges facing a same inward direction. In FIG. 7A, the three edges are rolled before sewing, which creates a smoother and more rounded appearance where the seam 42' is not emphasized. In FIG. 7B, the edges of the materials 39 and 40 are sewn together at a first seam 42", with the edges overlapping and facing in opposite directions.

The back covering 40 is then sewn along a separate seam 43 to the crescent-shaped section of material 41 at a location spaced below the seam 42". This creates a visual separation at location 43' along its edges that is reminiscent of the "throw-rug" look discussed above, such that the combination of the snap-attached seat cushion of FIG. 6 and the back cushion of FIG. 7A is very attractive and believed to be non-obvious in appearance.

Figure 8:
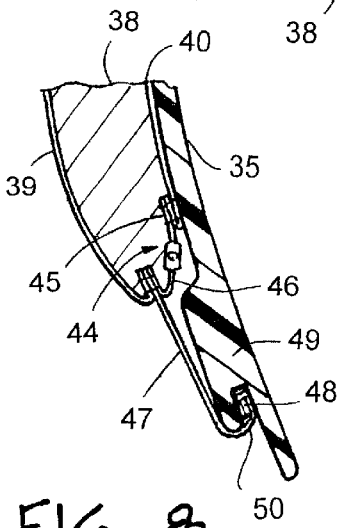
FIGS. 8, 8A, and 8B are side cross sectional views of three different bottom hem arrangements on the back cushion assembly, FIG. 8 being enlarged from the circled area VIII in FIG. 3.
Figure 8A:
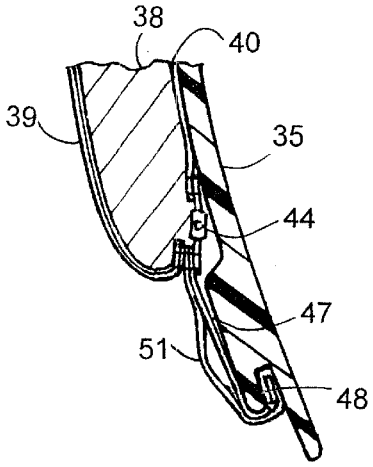

A bottom edge of the back cushion assembly 36 (FIG. 8) includes a zipper 44 with a top strip 45 sewn to a lower edge of the back covering 40 and a bottom strip 46. The bottom strip 46 is sandwiched together with bottom edges of the front covering 39 and a stretchable elastic strip 47 in an inwardly extending orientation and then sewn together. The elastic strip 47 is highly stretchable, such as 200% elongation or more. It includes a stiff strip 48 sewn along its lower edge. A thickened section 49 extends along a lower portion of the back shell 35 (i.e. its back shell), and includes a downwardly facing recess 50. The elastic strip 47 is stretched and the stiff strip 48 is rolled over and tucked into the recess 50 while maintaining tension on the elastic strip 47. This pulls the back cushion assembly 36 downwardly. This tension is important because a center of panel 54 (i.e. the lumbar region)(FIG. 4) of the back shell 35 is flexible. Thus, when the back shell 35 is flexed to a more planar condition, the back cushion assembly 36 must "absorb" some of the excess material. The elastic strip 48 helps accomplish this purpose. In FIG. 8, all edges of materials 39, 46 and 47 extend inwardly in the same direction. In FIG. 8A, the strip 46 extends downwardly. This creates a "puffy" condition such that a lower edge of the cushion assembly 36 bellows out in a forward direction. This creates a "throw-rug" appearance complimentary of the structure shown in FIGS. 6 and 7B, although it is noted that the lower edge of the back cushion assembly 36 is so low that it is not particularly easy to see.

In FIG. 8A, there is shown a fire-resistant material 51 that overlays a front of the elastic strip 48. The fire-resistant material 51 is sewn loose to the elastic strip 48 when the elastic strip 48 is in a relaxed state, so that when the elastic strip 48 is stretched, the fire resistant material 51 does not limit stretching the elastic strip 48. When attached and the back shell 35 is in its natural concave condition, the fire resistant material 51 is basically in a semi-taut condition. When the back shell 35 is flexed toward a planar condition, the fire resistant material 51 becomes loose, but this is not a problem since a person seated in the chair covers up an objectionable appearance. The fire-resistant material 51 is included when a local ordinance or law requires that chairs be resistant to fire damage.

Figure 8B:
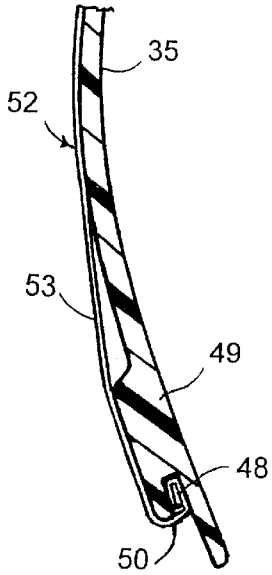
Figure 9:
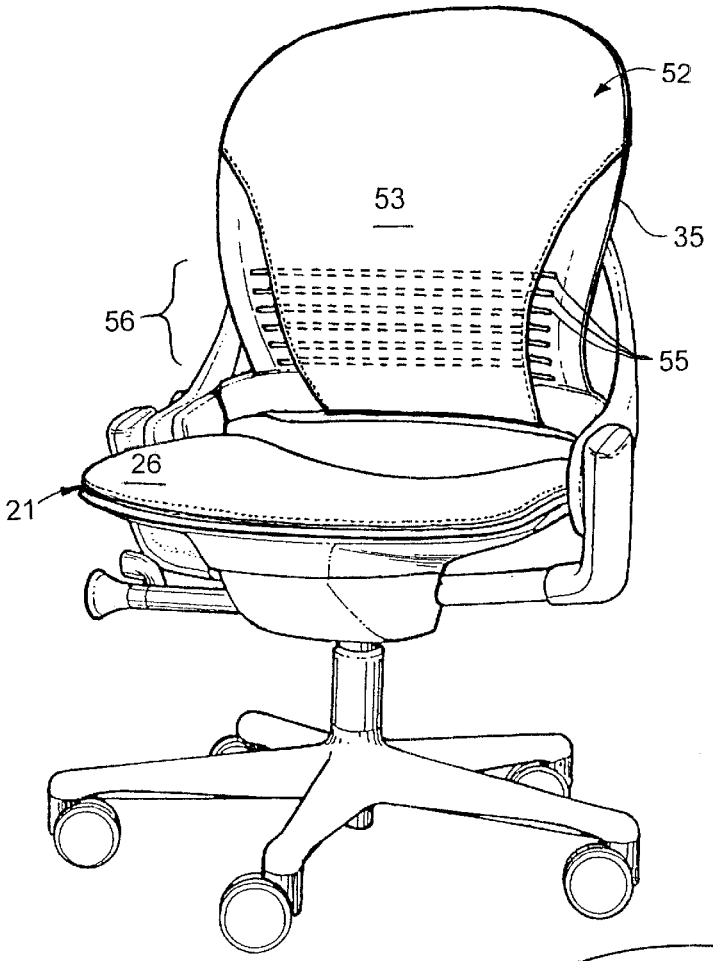
FIG. 9 is a front perspective view of a chair embodying the present invention.
Figure 10:
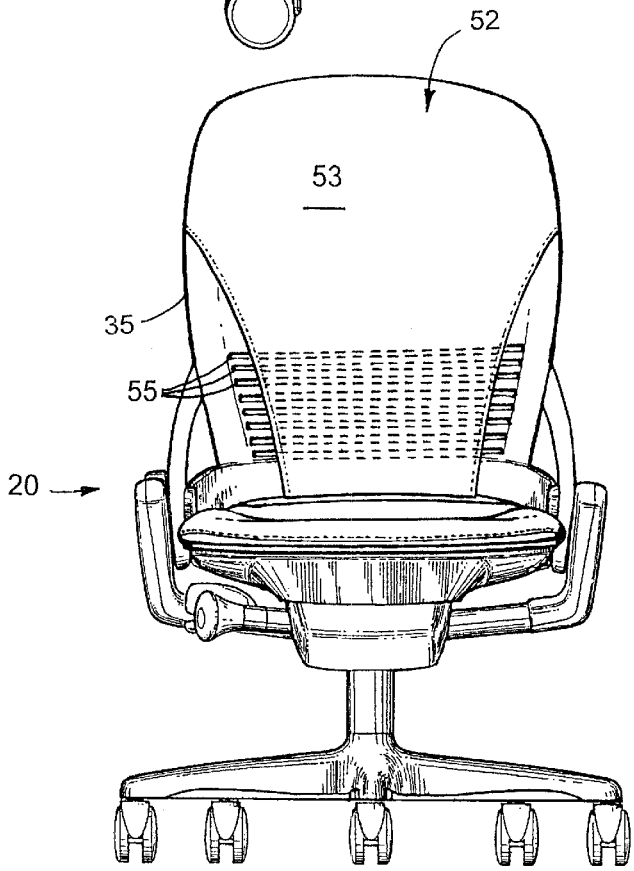
FIG. 10 is a front view of the chair in FIG. 9.
Figure 11:
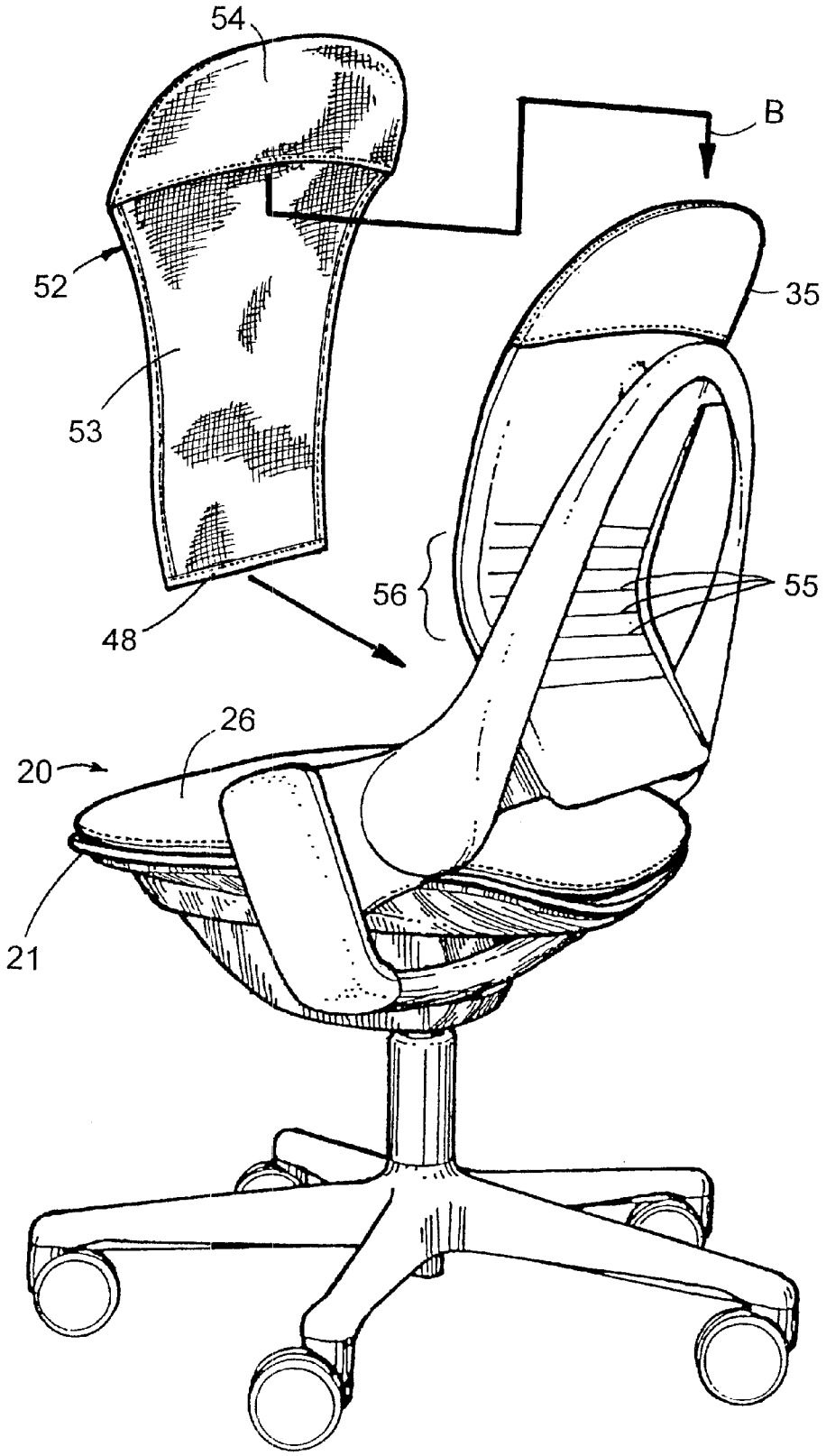
FIG. 11 is an exploded side perspective view of FIG. 10.

A vest or back covering 52 (FIGS. 9–11) includes a semi-transparent front panel 53 of material sewn to a crescent-shaped rear panel 54 (FIG. 11) of similar material to form a sock-like cavity 41'. The particular material of panels 53 and 54 are sold under a tradename "Powernet" by Milliken & Company, and are warp knit, gauge 64 GG, 85% nylon and 15% Lycra, with a square weight of 4.2 per yard. The material can be colored to match chair aesthetics, and has an elasticity of about 10% to 25%. They provide a see-through property where the images through the material are visible and distinguishable, but have a ghost-like quality. An important aspect is that they are transparent, semi-transparent or translucent so that the horizontal slots 55 in the lumbar region 56 can be seen, both for aesthetics and function. Also, this allows the position of a vertically-adjustable lumbar panel (not specifically shown) between the shell 35 and the vest 52 can be seen. At the same time, the panel 53 prevents a seated user's back from being pinched within the slots 55 as the seated user flexes their lower back. Attachment of the vest 52 is similar to that of back cushion assembly 36. Specifically, the back covering 52 is pulled downwardly onto a top of the back support structure 35 in direction "B" (FIG. 11). A stiff strip 48 sewn along a lower edge of the panel 53 is rolled and tucked into the recess 50 (FIG. 8B). The material of panel 53 is sufficiently elastic to stretch and keep tension on the material of panel 53 even when the back shell 35 is flexed toward a more planar condition.

In one form, a back cushion assembly is provided that can be pulled downwardly in direction "B" (FIG. 4) onto a back support structure for assembly. The back cushion assembly includes a top section forming a sock that engages the back support structure, and a stretch fabric strip along its bottom edge that assists in retaining the back cushion assembly to the back, and further potentially includes a fire-resistant strip that overlays the stretch fabric strip to reduce damage in the event of a fire. To remove the back cushion assembly for cleaning, the procedure is reversed. In another form, a removable fabric vest is provided that is configured to pull downwardly over the back (FIG. 11) and releasably attach to a bottom edge of the back. The vest covers a majority of the face of the back and, in a preferred form, is of a see-through material such that horizontal slots in the back can be seen. To remove the vest, the above procedure is reversed. A seat cushion assembly is provided that snap-attaches to a seat support structure. To remove the seat cushion assembly, the procedure is reversed. Accordingly, the seat cushion and the back cushion (or the back vest) can be quickly and easily removed for cleaning (dry-cleaning or washing), repair, maintenance, and sanitizing, and then reinstalled quickly and easily. Also, customer's own materials can be easily used in the present inventive arrangement.

Figure 14:
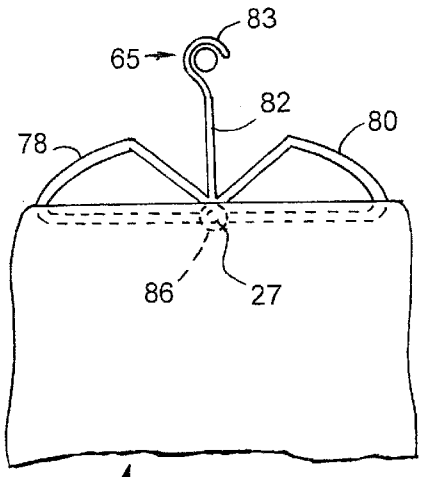
FIG. 14 is a plan view of the hanger shown in FIG. 12 and seat cushion assembly hung on the hanger.
Figure 13:
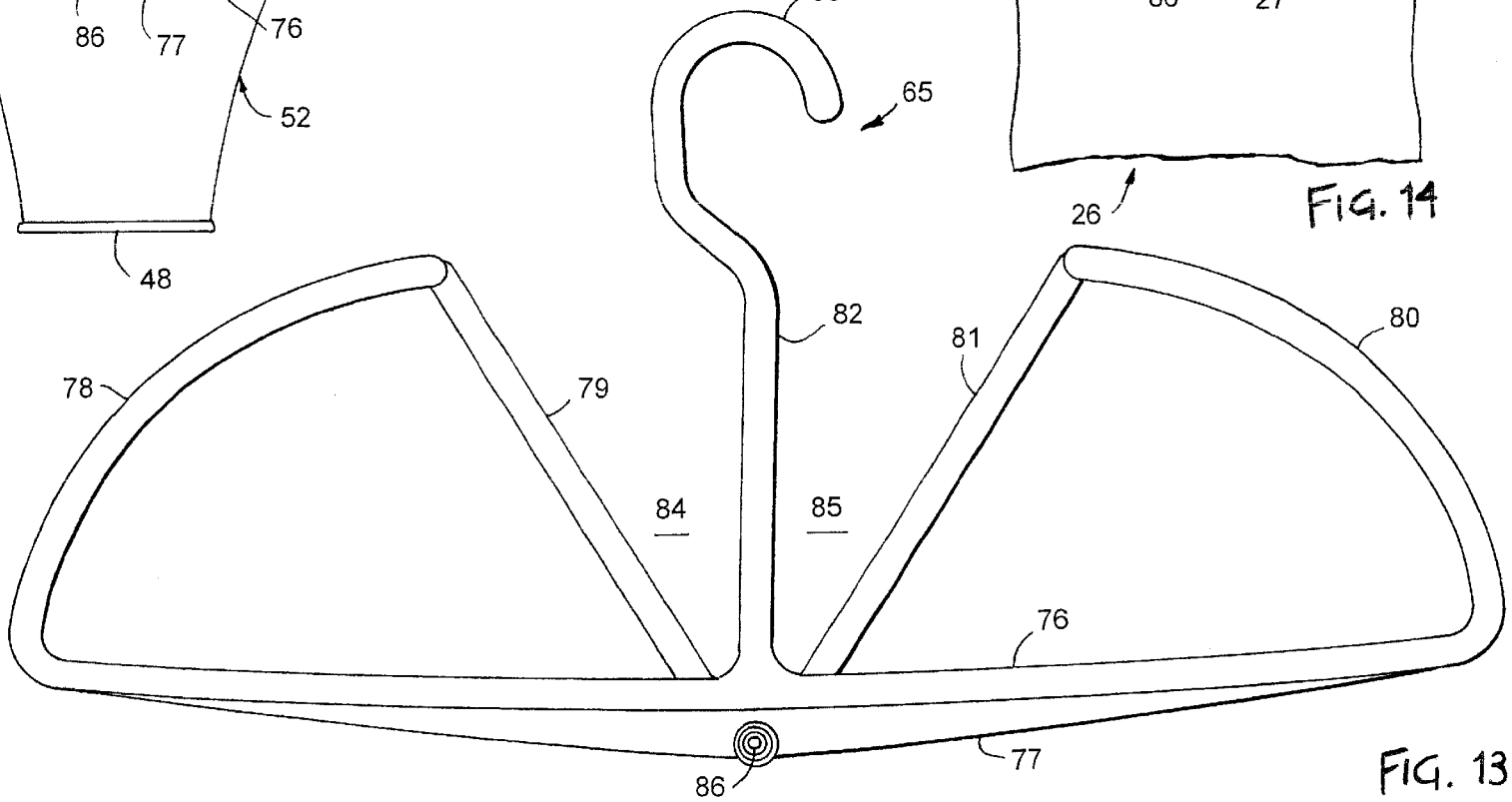
FIG. 13 is a plan view of the hanger shown in FIG. 12.
Figure 12:
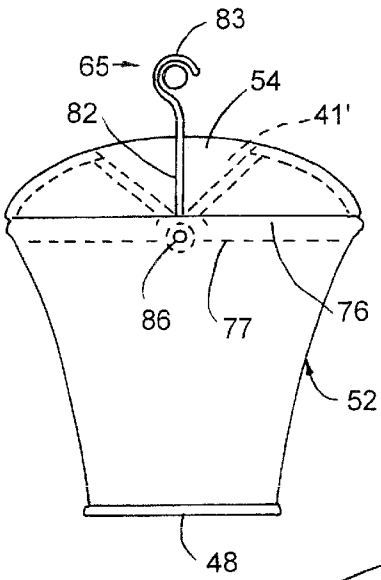
FIG. 12 is a plan view of a hanger and a vest positioned on the hanger.

A hanger 65 (FIGS. 12–14) is provided that is configured to releasably hold an extra vest 52 or back cushion assembly 36 in a non-wrinkling hung-up position. Multiple vests 52 may be sold for a given chair, and chair owners will want to store these vests in a manner that prevents wrinkling or that facilitates drying or display. The present hanger 65 accomplishes that purpose. The hanger includes a bottom horizontal runner 76 and stiffening flange 77. Side wings 78 and 80 extend arcuately upwardly from ends of the runner 76, and inwardly angled stiffeners 79 and 81 extend from the side wings 78 and 80 toward a center of the runner 76. A vertical runner 82 extends up from the center of the runner 76, and includes a hooked section 83 for engaging a coat-hook or clothes-bar. The sections 83, 82, 76, 77 and 79 have a round cross section for optimal material flow, such that they define the equivalent of runners in the molding dies for the hanger 65. while the sections 77, 79 and 81 are relatively flat for reduced material consumption and to prevent distortion of the hanger portions forming the pocket. The wings 78 and 80 form an arc that is similar to a top edge of the back shell 35. The vest 52 is hung on the hanger 65 by placing the members 78, 79, 80 and 81 into the cavity, but with the panels 53 and 54 of the vest 52 (or of the back covering 40) being positioned on one side of the vertical runner 82. The panel 54 (or back covering 40) extends through spaces 84 and 85 when the vest 52 is hung on hanger 65. One or more snaps or fastening devices 86 are provided on flange 77 so that an extra seat cushion assembly 26 can be snap-attached to the hanger 65 and supported thereon.

In the foregoing description, those skilled in the art will readily appreciate that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A chair comprising:

a seating unit including a seat structure and a back structure, at least one of the structures including a flexible plastic shell with a face adapted to support a person seated thereagainst, the face having an arrangement of recesses and an arrangement of first connectors positioned in the recesses and recessed into the face so that the face presents a relatively smooth surface; and a removable bendable cushion assembly including a cushion, and further including a top covering and a flexible stabilizing bottom covering having less than a 5% elongation when stretched and that is attached to the top covering around the cushion, and still further including an arrangement of second connectors attached to the bottom covering proximate corners of the cushion and that are releasably attached to the first connectors for securing the cushion assembly to the one structure; the first and second connectors being configured to release and disengage when the removable cushion assembly is pulled from the one structure, the bendable cushion assembly not including a rigid plate member such that an accurate location of the second connectors depends on the stabilizing bottom covering.

2. The chair defined in claim 1, including locators configured to accurately locate the cushion assembly on the one structure.

3. The chair defined in claim 2, wherein the first and second connectors have male and female portions that engage and act as the locators.

4. The chair defined in claim 3, wherein the first and second connectors are the sole attachment devices that attach the cushion assembly to the one structure.

5. The chair defined in claim 4, wherein the first and second connectors comprise male and female components constructed to frictionally snap together.

6. The chair defined in claim 1, wherein the second connectors include at least four second connectors.

7. The chair defined in claim 6, wherein the bottom covering is a stabilizing fabric that has less than a 5% elongation when stretched in any direction.

8. The chair defined in claim 1, wherein the first and second connectors comprise male and female snap components constructed to frictionally snap together.

9. The chair defined in claim 8, wherein the arrangement of second connectors includes at least two second connectors at diagonally opposing corners of the one structure.

10. The chair defined in claim 8, wherein the arrangement of second connectors includes at least three second connectors along a side edge of the one structure.

11. The chair defined in claim 8, wherein the arrangement of second connectors includes at least six connectors, four of the at least six connectors being located at locations proximate but spaced from corners of the one structure and two of the at least six connectors being located along front and rear edges of the one structure.

12. The chair defined in claim 1, wherein the cushion assembly includes a cushion and at least one zipper arranged in a U-shaped pattern and adapted to unzip to receive the cushion and adapted to zip to enclose the cushion.

13. The chair defined in claim 1, wherein the plastic shell is relatively flat and does not include upwardly extending flanges along side edges of the plastic shell, such that the cushion assembly is not contained by the plastic shell but instead is retained solely by the connectors.

14. The chair defined in claim 1, wherein the one structure is the seat structure.

15. The chair defined in claim 14, wherein the plastic shell is relatively flat and does not include upwardly extending flanges along side edges of the plastic shell, such that the cushion assembly is not contained by the plastic shell but in stead is retained solely by the connectors.

16. The chair defined in claim 15, wherein the cushion assembly includes overlapping edges of the top and bottom coverings that are sewn with a hem; the hem, when the cushion assembly is attached to the one structure, being located above and spaced above edge portions of the seat structure to provide separation along the edge portions.

17. An assembly comprising:

a plastic shell with a face shaped to support a human body and including first connectors recessed into the face so that the face present a relatively smooth surface; and a cushion assembly comprising:

a cushion;

a covering on the cushion;

a low-stretch sheet under the cushion, the sheet being attached along edges to the covering to encapsulate the cushion, the cushion assembly being flexible and bendable, the sheet being chosen for dimensional stability and having an elongation when stretched of less than about 5% to facilitate alignment; and a plurality of releasable mechanical connectors attached to the sheet, the mechanical connectors being configured and arranged in a predetermined pattern on the sheet so that the mechanical connectors are accurately but removably attached to the first connectors on the plastic shell.

18. The assembly defined in claim 17, wherein the sheet comprises a dimensionally-stable polyester non-woven fabric.

19. The assembly defined in claim 17, wherein the mechanical connectors include snap-attach components that are configured to accurately locate the cushion assembly when the cushion assembly is attached to a chair as well as secure the cushion assembly to the chair.

20. The assembly defined in claim 19, wherein the cushion includes corners, and wherein the pattern of mechanical connectors includes connectors located proximate at least two opposing ones of the corners.

21. The assembly defined in claim 19, wherein the snap-attach components include at least three snap-attach connectors located across a front edge of the cushion.

22. The assembly defined in claim 17, wherein the sheet includes a zipper construction arranged in a U-shaped arrangement that is adapted to unzip to facilitate assembly of the cushion into the covering and the sheet, and adapted to zip to enclose the cushion after assembly.

23. The assembly defined in claim 17, wherein the sheet is sewn to the covering to create a perimeter hem that is located above a bottom surface of the sheet, so that the perimeter hem is spaced above a seat support when set on the seat support.

24. A furniture unit comprising:

a flexible shell made of unitary material and having a relatively flat face surface, at least one recess in the face, and at least one quick-attach first connector positioned in the at least one recess so that a face of the flexible shell is relatively smooth even with the first connector being present; and a flexible cushion assembly having a cushion, a covering, and a stabilizing sheet, the flexible cushion assembly not including a rigid plate member that would distribute stress, and including second connectors quick-attached to the first connectors for retaining the cushion assembly to the flexible shell.

25. The furniture unit defined in claim 24, wherein the cushion assembly consists of the cushion, the covering that covers the face, and the stabilizing sheet.

26. The furniture unit defined in claim 24, wherein the flexible shell comprises a back support.

27. The furniture unit defined in claim 24, wherein the flexible shell comprises a seat support.

28. An assembly comprising:

a seating unit including a seat structure and a back structure, at least one of the structures including a flexible plastic shell with a face adapted to support a person seated thereagainst, the face having recesses and including an arrangement of first connectors in the recesses; and a removable bendable cushion assembly including a cushion, and further including a top covering and a bottom covering that is attached to the top covering around the cushion, and still further including an arrangement of second connectors attached to the bottom covering and that are releasably attached to the first connectors for securing the cushion assembly to the one structure; the first and second connectors being configured to release and disengage when the removable cushion assembly is pulled from the one structure, the bendable cushion assembly not including a rigid plate member such that an accurate location of the second connectors depends on the bottom covering.

29. An assembly comprising:

a plastic shell with a face shaped to support a human body and including snap-attach first connectors recessed into the face so that the face presents a relatively smooth surface; and a cushion assembly comprising:

a bendable cushion;

a covering on the cushion;

a sheet under the cushion, the sheet being attached along edges to the covering to encapsulate the cushion, the cushion assembly being flexible and bendable and not including a rigid plate member; and a plurality of releasable mechanical connectors attached to the sheet, the mechanical connectors being configured and arranged in a predetermined pattern on the sheet so that the mechanical connectors are removably attached to the first connectors of the plastic shell.

30. The assembly defined in claim 29, wherein the sheet comprises a dimensionally-stable polyester non-woven fabric.

* * * * *